US010647113B2

(12) United States Patent
Ueki

(10) Patent No.: US 10,647,113 B2
(45) Date of Patent: May 12, 2020

(54) RECORDING HEAD AND RECORDING APPARATUS

(71) Applicant: CANON KABUSHIKI KAISHA, Tokyo (JP)

(72) Inventor: Hideyuki Ueki, Fuchu (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/186,389

(22) Filed: Nov. 9, 2018

(65) Prior Publication Data

US 2019/0143676 A1 May 16, 2019

(30) Foreign Application Priority Data

Nov. 16, 2017 (JP) ..... 2017-220951

(51) Int. Cl.
*B41J 2/045* (2006.01)
*B41J 2/05* (2006.01)
*B41J 19/00* (2006.01)

(52) U.S. Cl.
CPC ..... *B41J 2/04573* (2013.01); *B41J 2/0458* (2013.01); *B41J 2/04543* (2013.01); *B41J 2/05* (2013.01); *B41J 19/005* (2013.01)

(58) Field of Classification Search
CPC .. B41J 2/04573; B41J 2/04543; B41J 19/005; B41J 2/0458; B41J 2/05
See application file for complete search history.

(56) References Cited

FOREIGN PATENT DOCUMENTS

JP 2014-714 1/2014
JP 2014000714 A * 1/2014

* cited by examiner

*Primary Examiner* — Bradley W Thies
(74) *Attorney, Agent, or Firm* — Venable LLP

(57) ABSTRACT

Provided is a recording head including: a recording element; a delay circuit including a delay element and configured to supply a clock signal from a main body unit of a recording apparatus to the delay element; and a logical sum (OR) element configured to generate a clock state signal based on a logical sum of the clock signal and output from each delay element. The recording head detects a defect in the clock signal transmitted from the main body unit to the recording head based on the clock state signal, and sets the recording element to a disable state when a defect is detected in the clock signal.

17 Claims, 11 Drawing Sheets

RECORDING HEAD AND RECORDING APPARATUS

BACKGROUND OF THE INVENTION

Field of the Invention

The present invention relates to a recording head and a recording apparatus including the recording head.

Description of the Related Art

In general, a recording apparatus configured to record or print an image or other such information on a paper sheet or other such recording medium includes a recording head including a plurality of recording elements to perform an actual recording operation and a main body unit including a controller configured to control the recording head, which are provided separately from each other. In order to perform recording on an entire surface of the recording medium, the recording apparatus is often configured so as to move the recording head relative to the main body unit by mounting the recording head to a carriage. When the recording head is configured to be moved relative to the main body unit, the main body unit and the recording head are electrically connected to each other by a cable based on a flexible printed circuit (FPC) substrate, for example. As one of the recording apparatus configured to move the recording head relative to the main body unit by mounting the recording head on the carriage, there is an ink jet recording apparatus capable of recording a color (multicolor) image as well by ejecting recording liquid (for example, ink) from an ejection orifice. The ink jet recording apparatus uses, as the recording head, an ink jet recording head including the ejection orifice and the recording element, for example, a heater element configured to generate energy for ejecting liquid droplets from the ejection orifice. The ink jet recording apparatus then repeats a recording operation for performing recording by ejecting recording liquid onto the recording medium while moving the ink jet recording head in a main scan direction and a conveying operation for conveying the recording medium in a sub-scan direction perpendicular to the main scan direction, to thereby record an image or other such information on the entire surface of the recording medium. In recent years, the amount of data transferred to the recording head has been increasing in response to the demand for improvement in recording speed and recording density of the ink jet recording apparatus. This has led to the ink jet recording apparatus transmitting recording data and control data for controlling the recording head to the recording head in a form of a command.

Even in the ink jet recording apparatus, the main body unit and the recording head of the recording apparatus are electrically connected to each other by the cable, but the repetition of reciprocation of the recording head in the main scan direction may cause a wire break in the cable. The wire break does not necessarily mean that a signal is completely interrupted, and the signal is sometimes transmitted and is sometimes not transmitted in a broken wire portion depending on, for example, how much the cable is bent. As a result, an abnormality may occur in a clock signal only at a particular timing to cause a defect in clock data or cause, for example, chattering. The recording head, which is configured to generate a drive signal to be applied to the recording element in order to drive the recording element in the recording head based on the received command, requires the clock signal in order to determine a time width of the drive signal and a timing thereof. When a defect occurs in the clock data or chattering occurs, the drive signal having an abnormal pulse width is applied to the recording element, the repetition of which may cause a fault in the recording head.

In Japanese Patent Application Laid-Open No. 2014-000714, there is disclosed an ink jet recording apparatus including, between a cable and a recording head, a detection circuit for an enable signal for defining a driving timing, which is configured to send the enable signal to the recording head together when sending data to the recording head via the cable. The detection circuit is configured to inhibit a recording element from being driven when the enable signal is not asserted, to thereby perform monitoring so as to prevent an excessive current from flowing into the recording element.

Incidentally, as the recording head to be connected to the main body unit of the recording apparatus by a cable becomes more widespread, it is demanded to detect a wire break in the cable more appropriately. The present invention has an object to provide a recording head capable of detecting a wire break in a cable based on a clock signal transmitted to the recording head and a recording apparatus including such a recording head.

SUMMARY OF THE INVENTION

According to one embodiment of the present invention, there is provided a recording head, which includes a recording element, and is configured to perform recording on a recording medium by driving the recording element based on a first clock signal transmitted from a main body unit of a recording apparatus via a cable, the recording head including a first generation unit configured to generate a second clock signal by shifting a phase of the first clock signal by at least one-half phase; a second generation unit configured to generate a logical sum signal based on a logical sum of a plurality of signals including the first clock signal and the second clock signal; and a detection unit configured to detect whether a wire break has occurred in the cable based on the logical sum signal.

According to one embodiment of the present invention, there is provided a recording apparatus including the recording head of the one embodiment of the present invention, the recording head being configured to form an image on a recording medium.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Figure 1:
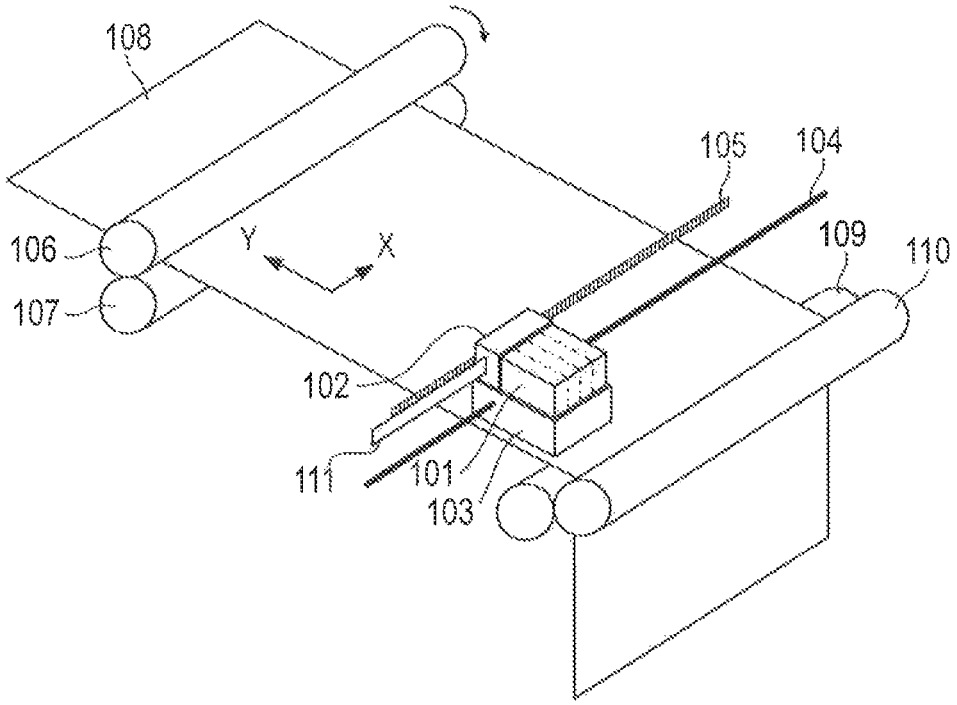
FIG. 1 is a perspective view for illustrating a schematic configuration of a recording unit of an ink jet recording apparatus according to one embodiment of the present invention.

Now, one embodiment of the present invention is described with reference to the accompanying drawings. The following description is given of a case in which a recording apparatus according to the embodiment of the present invention is an ink jet recording apparatus configured to subject a recording medium to recording based on recording data by ejecting ink. However, the recording apparatus to which the present invention is applied is not limited to the ink jet recording apparatus, and any form of apparatus that includes a recording head and is configured to record an image or other such information on a paper sheet or other such recording medium may be employed. FIG. 1 is a diagram for illustrating a schematic configuration of a recording unit of the ink jet recording apparatus being the recording apparatus according to the embodiment of the present invention.

As illustrated in FIG. 1, the ink jet recording apparatus is capable of continuously recording an image or other such information on a recording medium 108, for example, a recording paper sheet stored in a recording sheet tray (not shown) to be fed from the recording sheet tray. The recording medium 108 is nipped by a pair of feed rollers 109 and 110 to be fed, and is nipped by a sheet feeding roller 106 and an auxiliary roller 107. The sheet feeding roller 106 is rotated in a direction indicated by the arrow, to thereby convey the recording medium 108 in a Y direction illustrated in FIG. 1. A guide shaft 104, which is parallel with the surface of the recording medium 108 and extends in an X direction illustrated in FIG. 1, is provided above a surface of the recording medium 108. A carriage 103 is engaged with the guide shaft 104 so as to be free to slide, which enables the carriage 103 to move along the guide shaft 104. In addition, an encoder scale 105 is provided so as to be opposed to the carriage 103 in parallel with the guide shaft 104. The encoder scale 105 is provided with, for example, slits with a density of 150 slits per 25.4 mm. The encoder scale 105 is irradiated with light emitted by an encoder sensor (not shown) to detect light transmitted therethrough by the carriage 103. The carriage 103 outputs a phase-A signal and a phase-B signal based on the light transmitted through the encoder scale 105 in accordance with a scan position thereof, namely, a position in the X direction. The phase-B signal is in a phase relationship delayed from the phase-A signal by 90 degrees. By counting the phase-A signals and the phase-B signals, it is possible to know the accurate scan position of the carriage 103. The X direction is a direction of reciprocating the carriage 103, and is referred to as "main scan direction". The Y direction is a direction of conveying the recording medium 108, and is referred to as "sub-scan direction".

A recording head 102 being an ink jet recording head and an ink cartridge 101 are each mounted to the carriage 103 in a detachably attachable manner. The carriage 103 reciprocatingly conveys the recording head 102 in the X direction. The ink cartridge 101 is configured to individually store inks of four colors of black (Bk), cyan (C), magenta (M), and yellow (Y), and is integrally formed of storage chambers for the respective inks. The recording head 102 includes recording element arrays corresponding to the respective four inks stored in the ink cartridge 101, and is configured so that those recording element arrays form a single unit.

In order to execute recording by the recording head 102, a clock signal, command data, a latch signal, and other such signals and data are required, and the recording head 102 is electrically connected to a main body unit (not shown) of the recording apparatus via a cable 111 to receive those pieces of data and those signals. In this embodiment, recording data indicating what kind of image and character are to be actually formed on the recording medium 108 and control data for controlling the recording head 102 are both sent to the recording head 102 as data in a form of a command, namely, as command data. Examples of the control data include control data for defining, for example, a waveform of a drive signal to be applied to a recording element for ejecting ink and control data for turning on/off the driving of a heating element used for maintaining the ink at a predetermined temperature in the recording head 102.

Figure 2A:
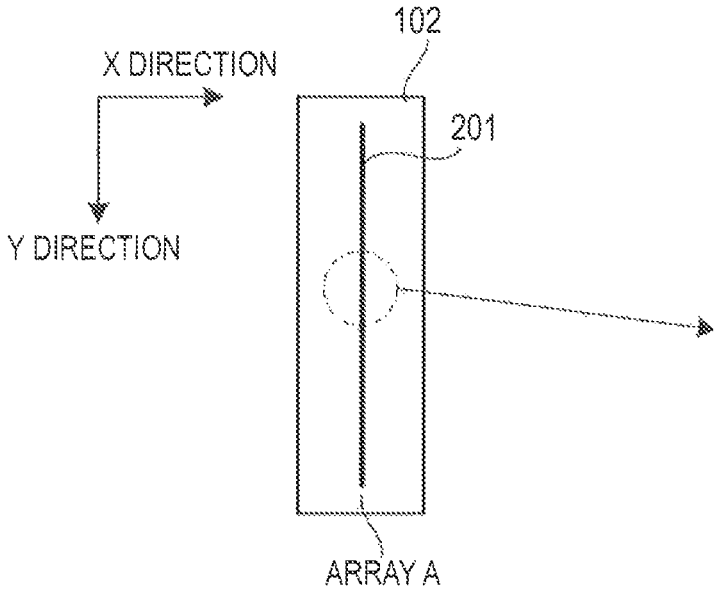
FIG. 2A and FIG. 2B are diagrams for illustrating a configuration of a recording head.
Figure 2B:
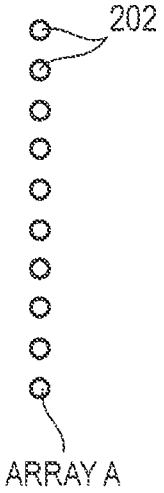

FIG. 2A is a diagram for illustrating a configuration of the recording head 102. In this case, a part of the recording head 102 relating to the ejection of ink corresponding to one color is illustrated. The "X direction" and the "Y direction" illustrated in FIG. 2A are the same as those illustrated in FIG. 1. The recording head 102 includes a recording element array 201 extending in the Y direction as indicated as "array A" in FIG. 2A. The recording element array 201 includes a plurality of, for example, 128 ejection orifices arranged in a line in the Y direction illustrated in FIG. 2A, and each of the ejection orifices is provided with a recording element 202 configured to generate energy for ejecting ink from the corresponding ejection orifice. In this embodiment, the recording element 202 is an electrothermal converter configured to generate thermal energy for foaming the ink. FIG. 2B is an enlarged view of a circled part in FIG. 2A. The number of recording elements 202 provided to one recording element array 201, namely, the number of ejection orifices is not limited to 128, and may be increased or decreased appropriately. While the recording head 102 is being conveyed in the X direction, the recording elements 202 are selected based on the recording data and driven in accordance with a conveyance timing, to thereby foam the ink and eject the ink from the corresponding ejection orifice by the energy of the foaming. With this operation, images, characters, and other such information are recorded on the recording medium 108.

Figure 3A:
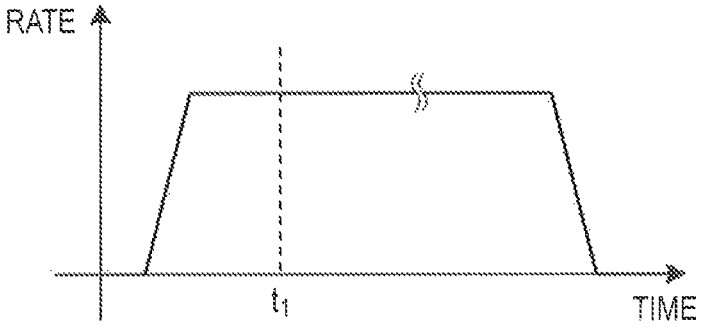
FIG. 3A and FIG. 3B are a graph and a diagram for showing and illustrating formation of recording using the recording head, respectively.
Figure 3B:
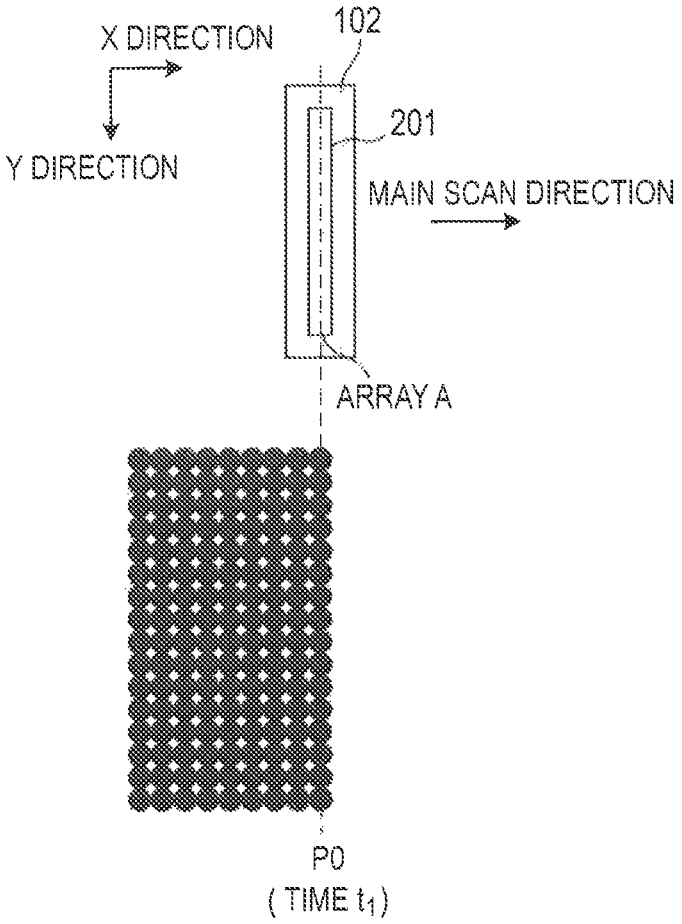

FIG. 3A and FIG. 3B are a graph and a diagram for showing and illustrating recording based on the ejection of the ink in accordance with the conveyance timing, respectively. FIG. 3A is the graph for showing a change in rate of the conveyance of the recording head 102 in the X direction (main scan direction). FIG. 3B is the diagram of recording formed by the recording element array 201. The recording element array 201 ejects the ink from the ejection orifice in accordance with the conveyance timing, and in the example shown in FIG. 3A and illustrated in FIG. 3B, uses the recording element array 201 in the array A to perform the recording at a position P0 of the recording medium 108 at a time t1. A monochrome image is formed in this example, but when a color image is to be recorded, it suffices to use the recording head 102 including the recording element arrays 201 for respective colors. In another case, it is also possible to divide the recording element array 201 into three regions along the Y direction and to cause the three regions to correspond to the colors of magenta (M), cyan (C), and yellow (Y).

Figure 4:
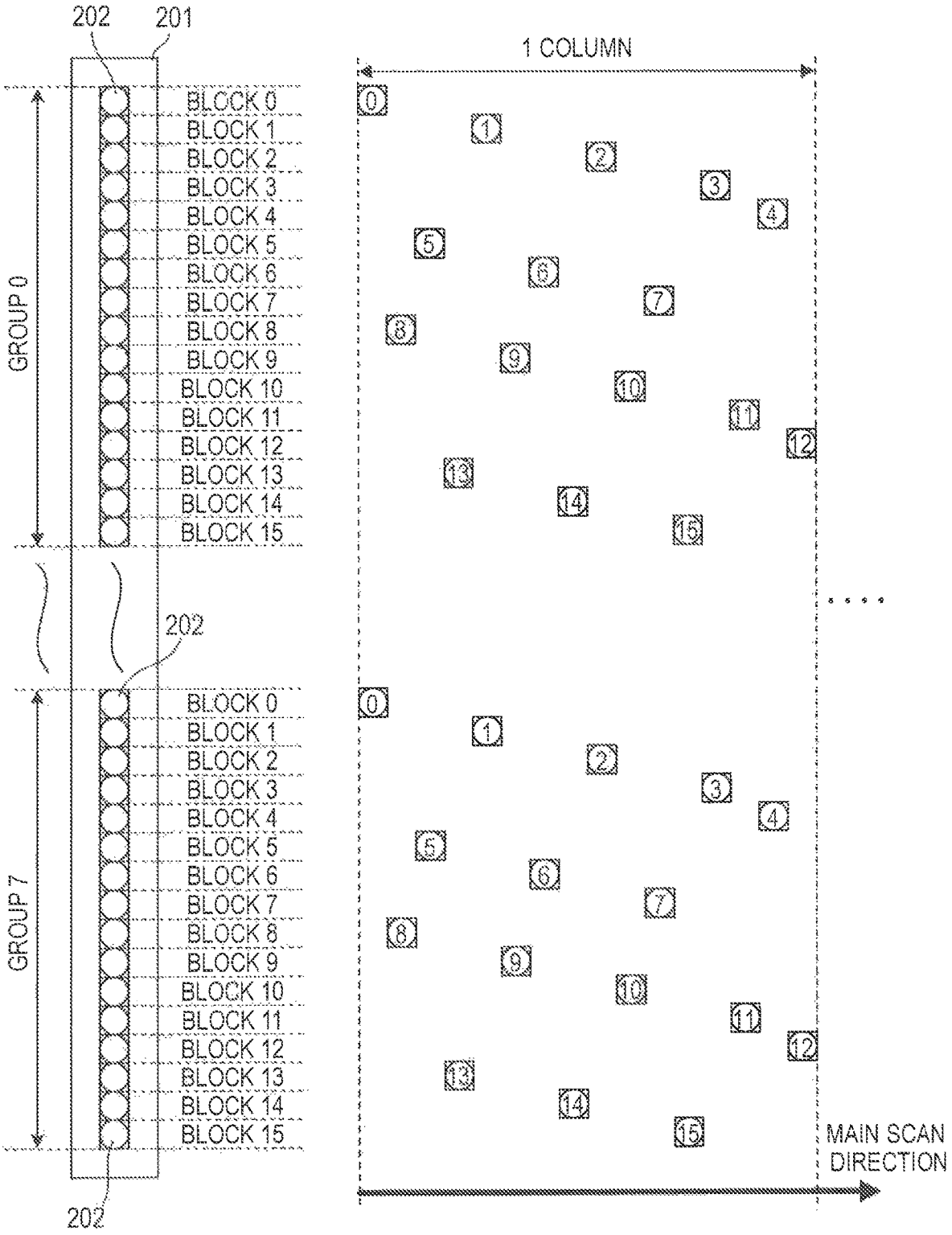
FIG. 4 is a diagram for illustrating time division driving to be performed on a recording element array.

FIG. 4 is a diagram for illustrating time division driving to be performed on the recording element array 201. In this case, the recording element array 201 includes 128 recording elements 202, but when 128 recording elements 202 formed of electrothermal converters are simultaneously driven, an extremely large current is caused to flow. Provision of a power supply that supports such a large current causes an increase in cost, and also leads to a fear that noise may occur due to the flow of a large current. Therefore, in this embodiment, a total of 128 recording elements 202 arranged in correspondence to 128 ink ejection orifices of the recording head 102 are divided into 8 groups from a group 0 to a group 7, each of which is formed of 16 recording elements. In addition, in each of the groups, the recording elements 202 are assigned to 16 blocks (from a block 0 to a block 15) on a one-to-one basis, and are successively driven with intervals in units of the recording elements 202 assigned to the same block. Through the driving of the whole blocks from the block 0 to the block 15, it is possible to finally drive all the recording elements 202 based on the recording data. In the example illustrated in FIG. 4, the respective groups are divided into the group 0 to the group 7 in order from the recording element 202 on an upstream side in the Y direction in units of 16 recording elements 202. In each of the groups, the blocks from the block 0 to the block 15 are assigned in order from the recording element 202 on the upstream side in the Y direction.

In the right part of FIG. 4, it is indicated by which one of the recording elements 202 the recording can be performed in a region corresponding to one column of the recording medium 108. A driving order of the recording elements 202 can be freely changed by configuring a drive circuit (not shown) provided in the recording head 102 so that the order of driving in units of the recording elements 202 assigned to the same block can be designated from the outside. In the example illustrated in FIG. 4, the driving is performed in the following order of the blocks: 0→8→5→13→1→9→6→14→2→10→7→15→3→11→4→12. However, for example, the driving may be performed in the following order of the blocks: 0→1→2→3→4→5→6→7→8→9→10→11→12→13→14→15. The driving (distributed driving) corresponding to one cycle, namely, one column is performed based on the driving order of the block, which is repeatedly executed in the main scan direction, to thereby execute the recording corresponding to one main scan.

Figure 5:
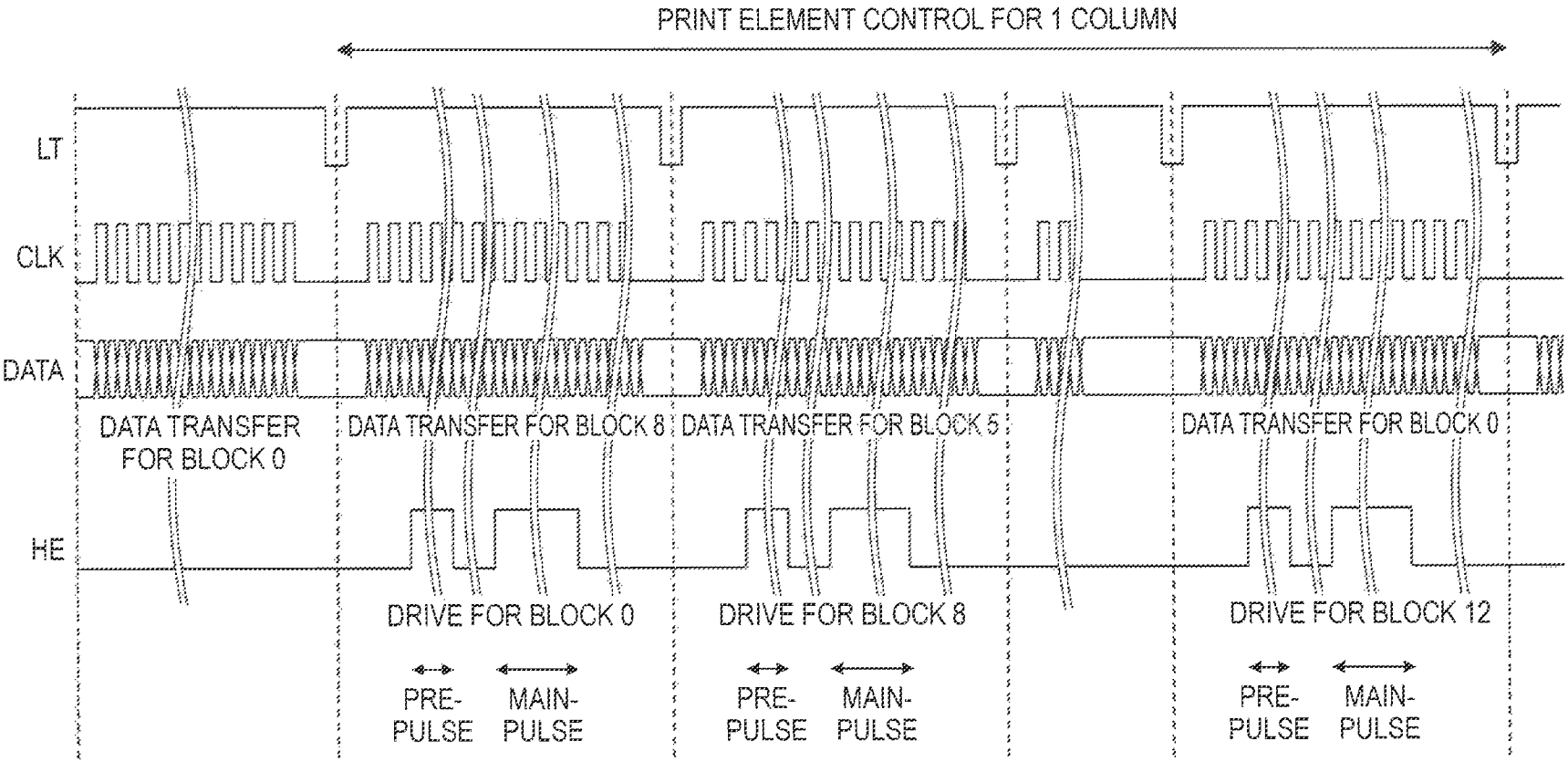
FIG. 5 is a timing chart for illustrating an example of a control signal to be transferred to the recording head.

In FIG. 5, a control signal to be transferred to the recording head 102 and signals generated by the recording head 102 are illustrated. The signals for controlling the recording head 102 includes a total of three interface signals including a clock signal CLK, a data signal DATA, and a latch signal LT. The data signal DATA is a signal for sending the command data to the recording head 102, and is sent out in synchronization with an edge of the clock signal CLK. The latch signal LT is a signal used for generating a timing at which the recording head 102 fetches the command data sent out from the main body unit. A plurality of recording element arrays are provided to the recording head 102 for color recording or other such purpose, and hence a plurality of signal lines for the data signal DATA are also required, but only one signal line is illustrated herein for the sake of convenience of description. A timing signal indicating a driving timing of the recording head 102 is generated by a controller (not shown) provided to the main body unit of the recording apparatus with an encoder signal indicative of the position of the recording head 102 being used as a reference. The controller first sends out the clock signal CLK and the data signal DATA synchronized with the clock signal based on the timing signal as illustrated in FIG. 5. For each command, the recording head 102 receives, for example, the recording data, a block driving signal indicating which block is to be driven, or data for defining the waveform of the drive signal in the form of a command, and determines the received data based on the latch signal LT. The recording data for each block includes information indicating which one of the recording elements 202 belonging to the relevant block in which group is to be driven. Data for defining the waveform of the drive signal is, for example, data for defining timings of a rising edge and a falling edge of a voltage pulse to be applied to the recording element 202 based on the clock signal CLK.

As illustrated in FIG. 5, the data signal DATA including the recording data is transmitted in units of blocks. Data on one block is sent to the recording head 102 in accordance with a timing of the latch signal LT. At a timing of the subsequent latch signal LT, data on the subsequent block is sent to the recording head 102, while the recording head 102 records the block targeted by the determined data based on the previously determined data. Specifically, the recording head 102 generates a drive signal HE to be applied to the recording element 202 based on a count value obtained by counting a clock number of the clock signal CLK received at the timing of the subsequent latch signal LT and the data for defining the waveform of the previously received drive signal. Then, the group is selected based on the recording data, and the drive signal HE is applied to the recording element 202 in the selected group to drive the recording element 202. Therefore, of the signals illustrated in FIG. 5, the latch signal LT, the clock signal CLK, and the data signal DATA are signals to be sent from the main body unit of the recording apparatus to the recording head 102, and the drive signal HE is a signal generated in the recording head 102. In order to stabilize the ejection, as illustrated in FIG. 5, the drive signal HE may be configured to output a pre-pulse signal having such a pulse width as to inhibit the ink from being ejected as a preliminary operation prior to a main pulse signal for performing the ejection.

In order to detect a transmission error in the command data, parity or cyclic redundancy check (CRC) may be added to the data signal DATA. In that case, the recording head 102 is provided with an error correction circuit. In addition, the recording head 102 may be provided with a protection circuit configured to forcedly disable the drive signal HE even when receiving such a command as to avoid returning the drive signal HE to a disable state. The protection circuit has a function of returning the drive signal HE to a disable state when the latch signal LT is asserted.

Figure 6A:
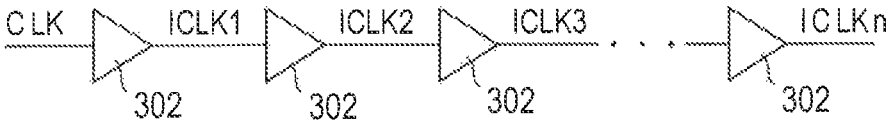
FIG. 6A and FIG. 6B are a circuit diagram and a timing chart for illustrating phase adjustment to be performed on the recording head, respectively.
Figure 6B:
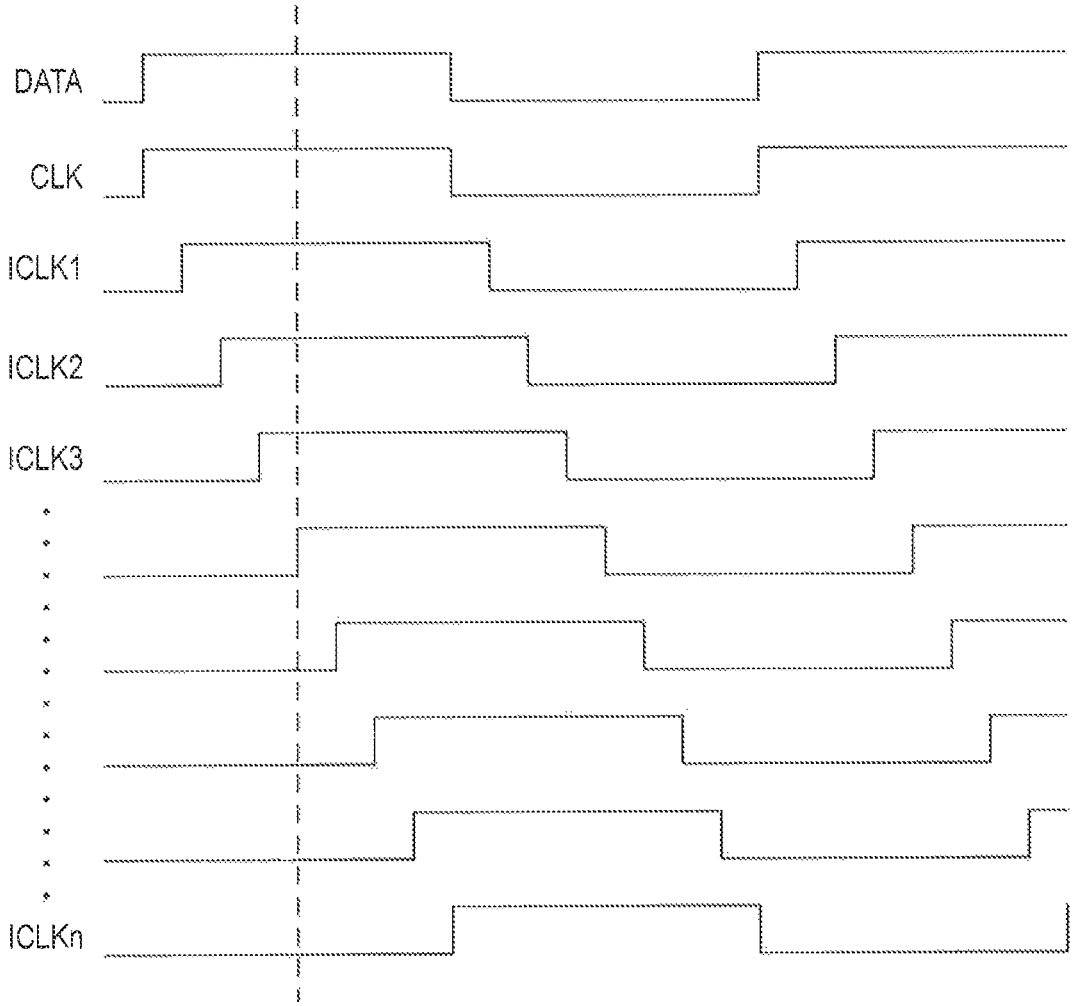

FIG. 6A is a circuit diagram for illustrating a delay circuit that can be mounted to the recording head 102, and FIG. 6B is a timing chart for illustrating an operation thereof. The data signal DATA is synchronized with the clock signal CLK, but when the clock signal CLK becomes high in speed, it may become difficult for the recording head 102 to fetch the data signal DATA in synchronization with the clock signal CLK. In view of this, as illustrated in FIG. 6A, delay elements 302 are connected in series in multistage, and the clock signal CLK is supplied to an input side thereof to generate a plurality of internal clock signals ICLK1 to ICLKn. Assuming that "n" delay elements 302 are connected in series and "i" is an integer equal to or larger than 1 and less than "n", an internal clock signal ICLKi is an output signal of an i-th delay element 302. The internal clock signals ICLK1 to ICLKn correspond to the clock signal CLK subjected to phase adjustment. An internal clock signal optimum for fetching the data signal DATA is used to fetch the data signal DATA. Therefore, even when the clock signal CLK used for the transfer to the recording head 102 is high in speed, it is possible to fetch the data signal DATA at an ideal timing.

Figure 7A:
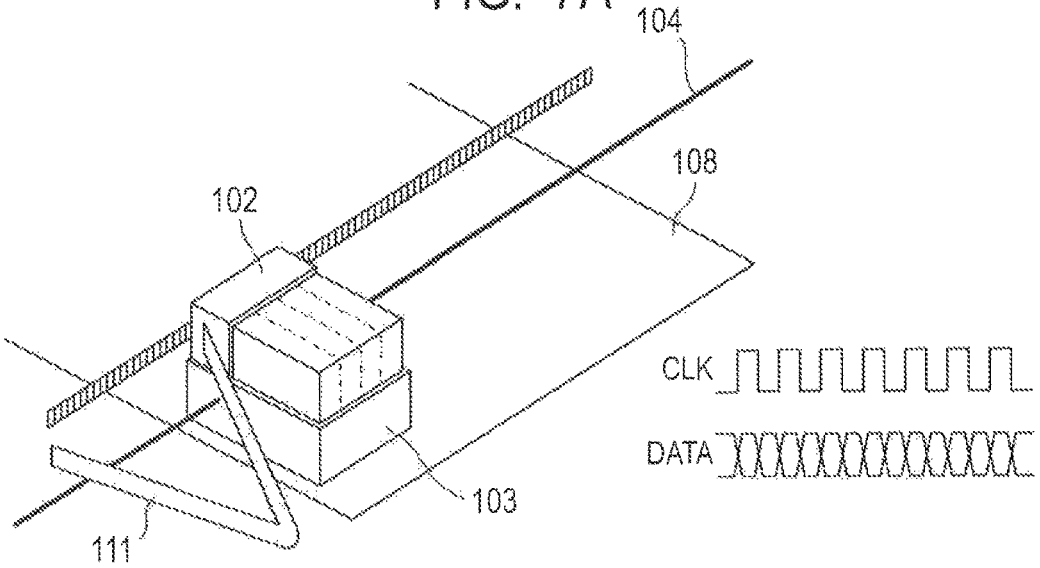
FIG. 7A, FIG. 7B, and FIG. 7C are explanatory diagrams for illustrating movement of the recording head in a main scan direction.
Figure 7B:
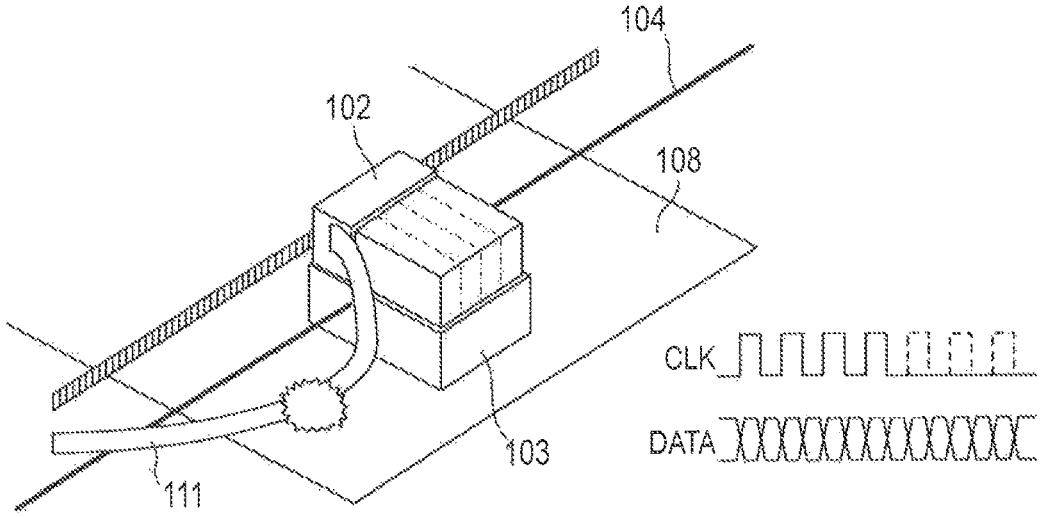
Figure 7C:
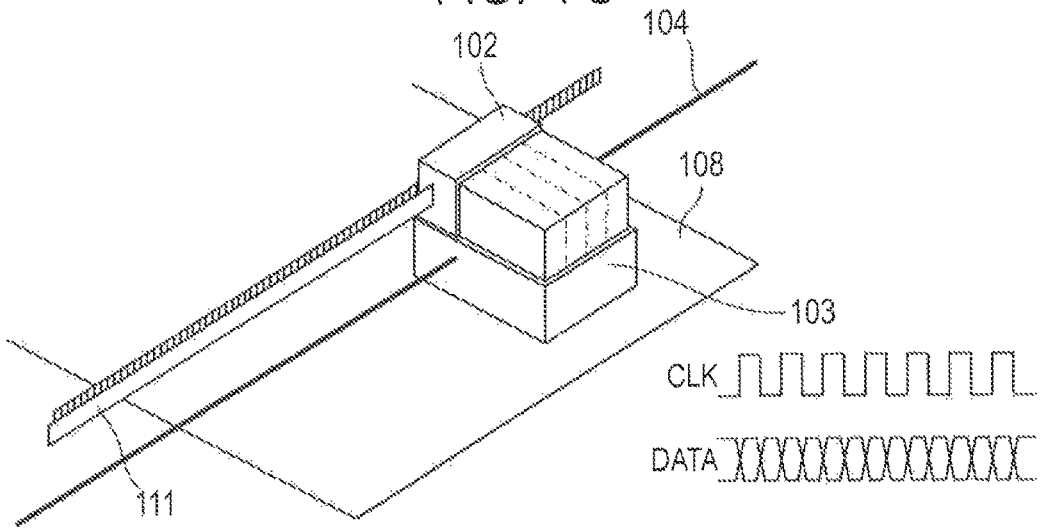

FIG. 7A, FIG. 7B, and FIG. 7C are diagrams for illustrating states of electrical connection using the cable 111 between the recording head 102 and the main body unit (not shown) of the recording apparatus for each of scan positions of the carriage 103 in the recording apparatus according to this embodiment. The carriage 103, to which the recording head 102 is mounted, is brought into slidable contact with the guide shaft 104 to reciprocate along the guide shaft 104. The state of the cable 111 is also changed in accordance with a sliding motion of the carriage 103. The carriage 103 repeats the reciprocation in accordance with the recording data, and hence along with the repetition of reciprocation, a wire break of a signal conductor may occur in the cable 111 due to, for example, deterioration or abrasion. At this time, the signal conductor is not completely broken to be separated, and depending on, for example, the state of bending of the cable 111, conductors may be brought into electrical contact with each other on both sides of the position of the broken wire, which may allow the transmission of a signal. For example, as illustrated in FIG. 7A or FIG. 7C, it may be possible to transmit the clock signal CLK to the recording head 102 without causing a defect in the data depending on the position of the carriage 103. In contrast, FIG. 7B indicates that a data loss is found in the clock signal CLK when the carriage 103 is located at a specific scan position. In the following description, the data loss in the clock signal CLK is also referred to as "clock defect". In the following description, it is assumed that the clock signal CLK is fixed at "0" at a time of loss of the clock based on a positive logic.

Figure 8:
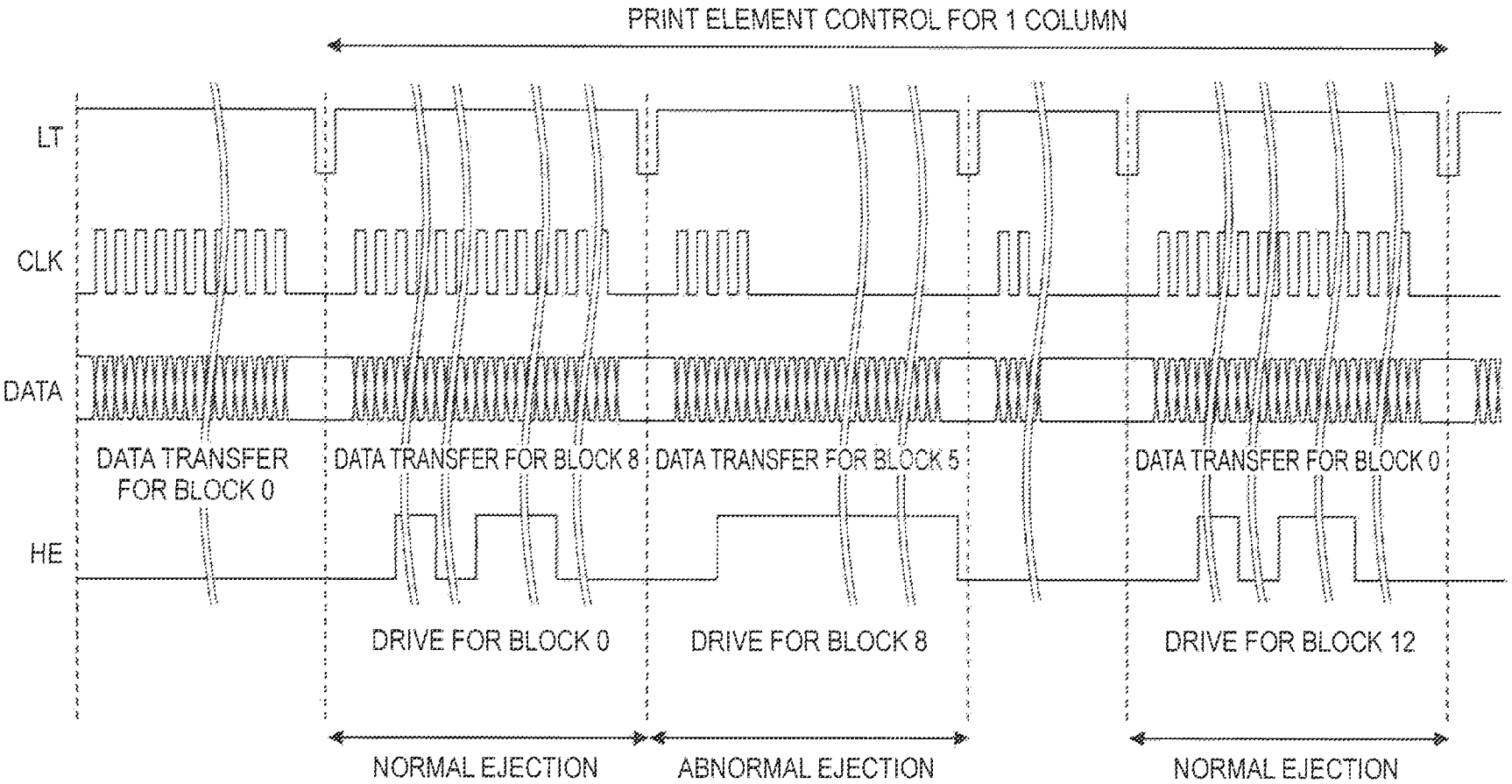
FIG. 8 is a timing chart for illustrating an example of the control signal exhibited when a wire break has occurred.

The drive signal HE used for driving the recording element 202 is generated so that the timings of the rising edge and the falling edge are determined by counting the clock number of the clock signal CLK transferred by the recording head 102. When loss of a clock occurs, the counting of the clock signal CLK is stopped. When the counting is stopped while the drive signal HE is kept in an enable state, the drive signal HE maintains the enable state as indicated as the case of abnormal ejection in FIG. 8, with the result that energy continues to be supplied to the recording element 202 for over a predetermined time period. In the example of FIG. 8, a defect occurs in the clock signal CLK during the application of a pre-pulse, with the result that the enable state of the drive signal HE continues until the latch signal LT is subsequently asserted. It is possible to detect erroneous transmission of data by adding parity or CRC to the data signal DATA, but error detection is performed after the latch signal LT is asserted, and hence it is not possible to protect the drive signal HE currently in an enable state. In other words, when loss of a clock occurs while the reception of the data for the subsequent block and the recording of the current block are being performed simultaneously, the drive signal HE cannot be disabled during a period in which the data of the subsequent block is being transferred. When the enable period of the drive signal HE repeatedly exceeds the predetermined time period, energy equal to or higher than allowed energy continues to be supplied to the recording element 202, which may lead to destruction of the recording head 102.

Figure 9:
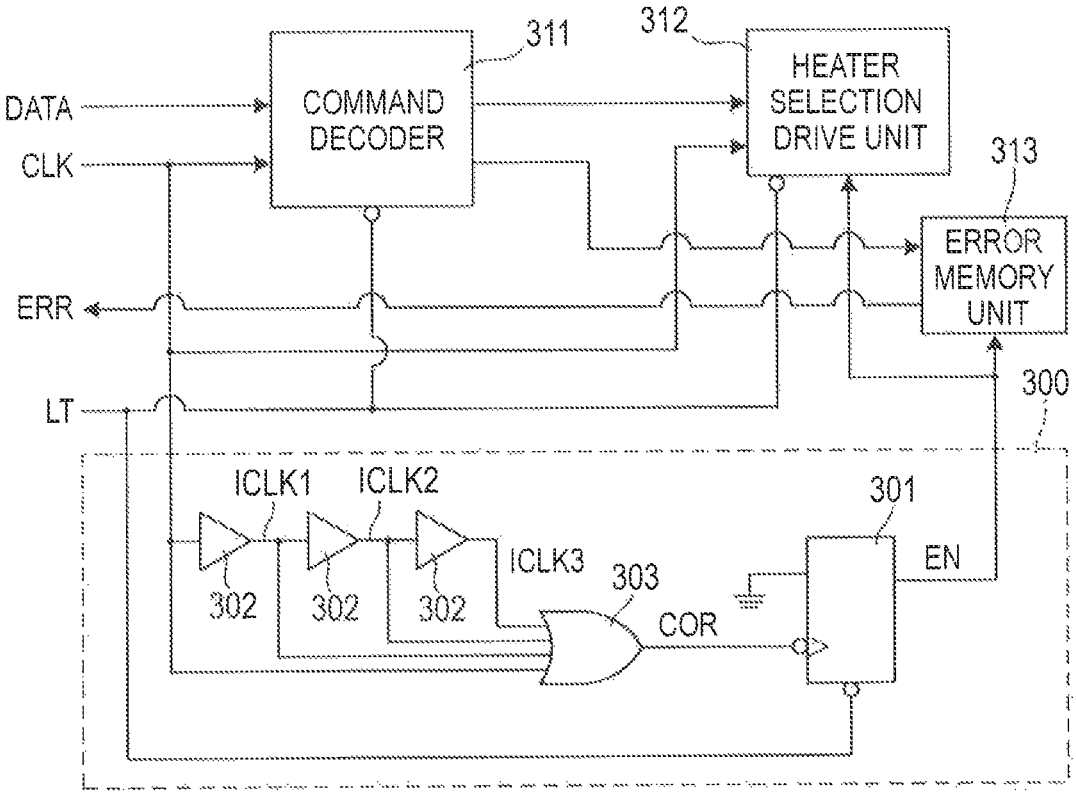
FIG. 9 is a circuit diagram of a main portion of the recording head including a detection circuit configured to detect loss of a clock.

Therefore, in this embodiment, in order to prevent the drive signal HE from being set to an enable state unintentionally, a wire break relating to the clock signal CLK is detected through use of the delay circuit for the phase adjustment of the clock signal CLK. FIG. 9 is a diagram for illustrating a configuration of a data receiving unit configured to receive the data from the main body unit of the recording apparatus in the recording head 102. The data receiving unit receives the clock signal CLK, the data signal DATA, and the latch signal LT, and includes a detection circuit 300, a command decoder 311, a heater selection drive unit 312, and an error memory unit 313. The error memory unit 313 stores loss of a clock value described later, but may not necessarily be provided. In addition, the data receiving unit includes a CRC detection unit configured to use CRC to detect an error and a circuit configured to drive the heating element used for maintaining the ink at a predetermined temperature in the recording head 102, which are not shown herein for the sake of convenience of description. The command decoder 311 decodes a command included in the data signal DATA based on the latch signal LT and the clock signal CLK. When the command is identified, the command decoder 311 transfers the command to the heater selection drive unit 312 or the error memory unit 313 depending on the type of the identified command. The heater selection drive unit 312 selects the recording element to be driven based on the recording data among the data transferred from the command decoder 311, and in order to eject the ink from the ejection orifice corresponding to the selected recording element, generates the drive signal HE to drive the recording element. To generate the drive signal HE, the heater selection drive unit 312 performs the counting of the clock signal CLK based on the content of the command for defining the waveform of the drive signal HE, and determines the timings of the rising edge and the falling edge of the drive signal HE. The heater selection drive unit 312 also receives an enable signal EN described later from the detection circuit 300, and when the enable signal EN is "0" (namely, disabled), the drive signal HE is set to a disable state irrespective of other conditions. The heater selection drive unit 312 corresponds to a drive unit configured to generate the drive signal HE to be used for driving the recording element 202 by performing the counting of the clock signal CLK based on a parameter designated by the command.

The detection circuit 300 is a circuit configured to detect loss of a clock through use of a delay circuit, and includes a latch element 301, the delay elements 302 connected in series in three stages, and a logical sum element (OR element) 303 having four inputs. The clock signal CLK is input to the first stage of the delay elements 302 connected in series in three stages, and the delay elements 302 each output a delayed clock signal, namely, each of the internal clock signals ICLK1 to ICLK3. For example, the delay elements 302 are each a delay element having a delay amount enough to shift its input clock by three-quarter phase. The logical sum element 303 obtains a logical sum of the clock signal CLK and the three internal clock signals ICLK1 to ICLK3, and outputs the logical sum as a clock state signal COR. The latch element 301 receives the input of the clock state signal COR and the latch signal LT, and outputs the enable signal EN to be output to the heater selection drive unit 312. The enable signal EN is a signal that becomes "1" (high state) when loss of the clock is not detected and the drive signal HE may be enabled and becomes "0" (low state) when loss of the clock is detected, that is, when the drive signal HE is required to be disabled. That is, when loss of a clock occurs, the enable signal EN transitions from the high state to the low state. The heater selection drive unit 312 determines whether or not to enable the drive signal HE by the enable signal EN.

The circuit illustrated in FIG. 9 is a circuit formed on the premise that the clock signal CLK is fixed at "0" at the time of loss of the clock. However, the clock signal CLK may be fixed to "1" at the time of loss of the clock depending on the circuit configuration based on a negative logic. At that time, in consideration of the fact that a logical sum operation based on the positive logic corresponds to a negative logical product based on the negative logic, a negative logical product (NAND) element may be used instead of the logical sum element 303, and the output of the negative logical product element may be set as a clock state signal. In the embodiment of the present invention, a logical sum element is assumed to include the negative logical product element as well.

Figure 10:
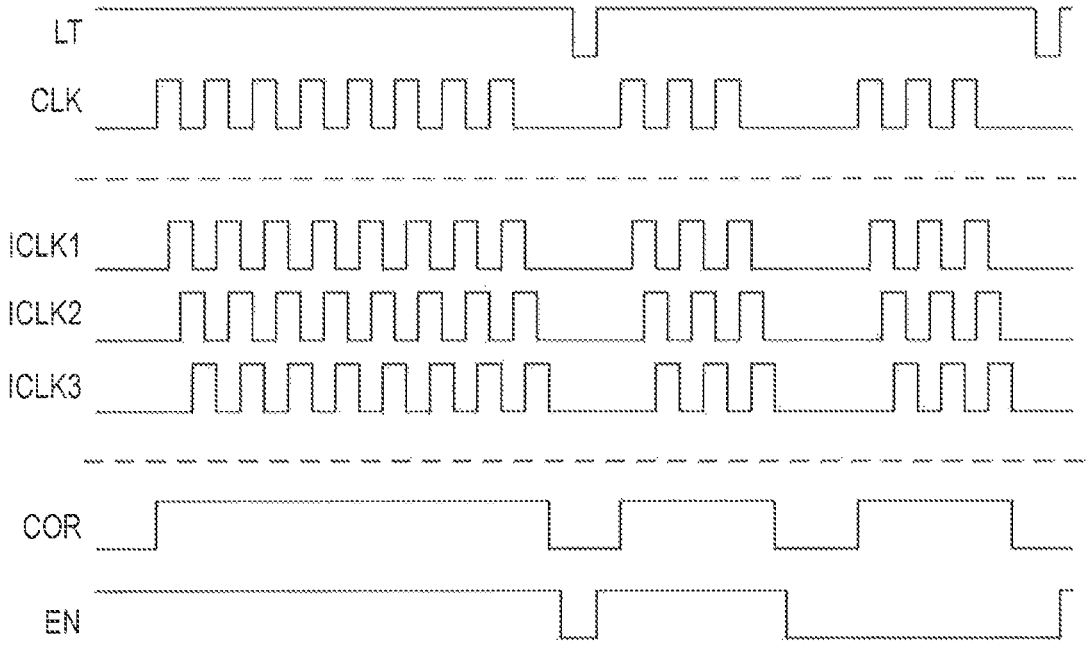
FIG. 10 is a timing chart for illustrating the detection of loss of the clock.

FIG. 10 is a timing chart for illustrating the operation of the detection circuit 300. When taking the logical sum of the input clock signal CLK and the internal clock signals ICLK1 to ICLK3 delayed by the delay elements 302 in the three stages, it is possible to generate a clock state signal COR that becomes "1" only when the clock signal CLK is generated. The latch element 301 is configured by a flip-flop so that the enable signal EN is set to "1" at the rising edge of the latch signal LT and "0" of the enable signal EN is determined through use of the falling edge of the clock state signal COR. As a result, the detection circuit 300 can generate such an enable signal as to become "0" when the output of the clock signal CLK is finished, that is, when an occurrence of loss of the clock is detected. The latch element 301 is an element to be reset by the latch signal LT, and can therefore output the enable signal EN of "1" after the assertion of the latch signal LT until the continuous input of the clock signal CLK is confirmed. Therefore, as illustrated in FIG. 10, when there is no clock defect before the latch signal LT is asserted, the enable signal EN becomes "0", that is, is enabled, after the last clock is received. In contrast, when there is loss of a clock before the latch signal LT is asserted, the enable signal becomes "0", that is, is disabled, in response to the falling edge of the last clock signal CLK before the defect. This allows the drive signal HE to maintain a disable state until the subsequent latch signal LT is asserted, which allows the driving of the recording element 202 to be stopped safely.

In the example of FIG. 9, the delay elements 302 are connected in series in three stages, but the number of serial stages of the delay elements 302 is not limited to three, and the number of serial stages of the delay elements 302 may be any number equal to or more than one as long as the number allows a defect state of the clock signal CLK to be confirmed. In addition, as long as the defect state of the clock signal CLK can be confirmed, the delay amount of the delay element 302 is not limited to three-quarter phase of the clock. The serial connection of the delay elements 302 in the detection circuit 300 illustrated in FIG. 9 is the same as the delay circuit illustrated in FIG. 6B. Therefore, when a delay circuit for the phase adjustment of the clock signal CLK is provided, the delay circuit can be used to configure the detection circuit 300 for loss of a clock.

Figure 11:
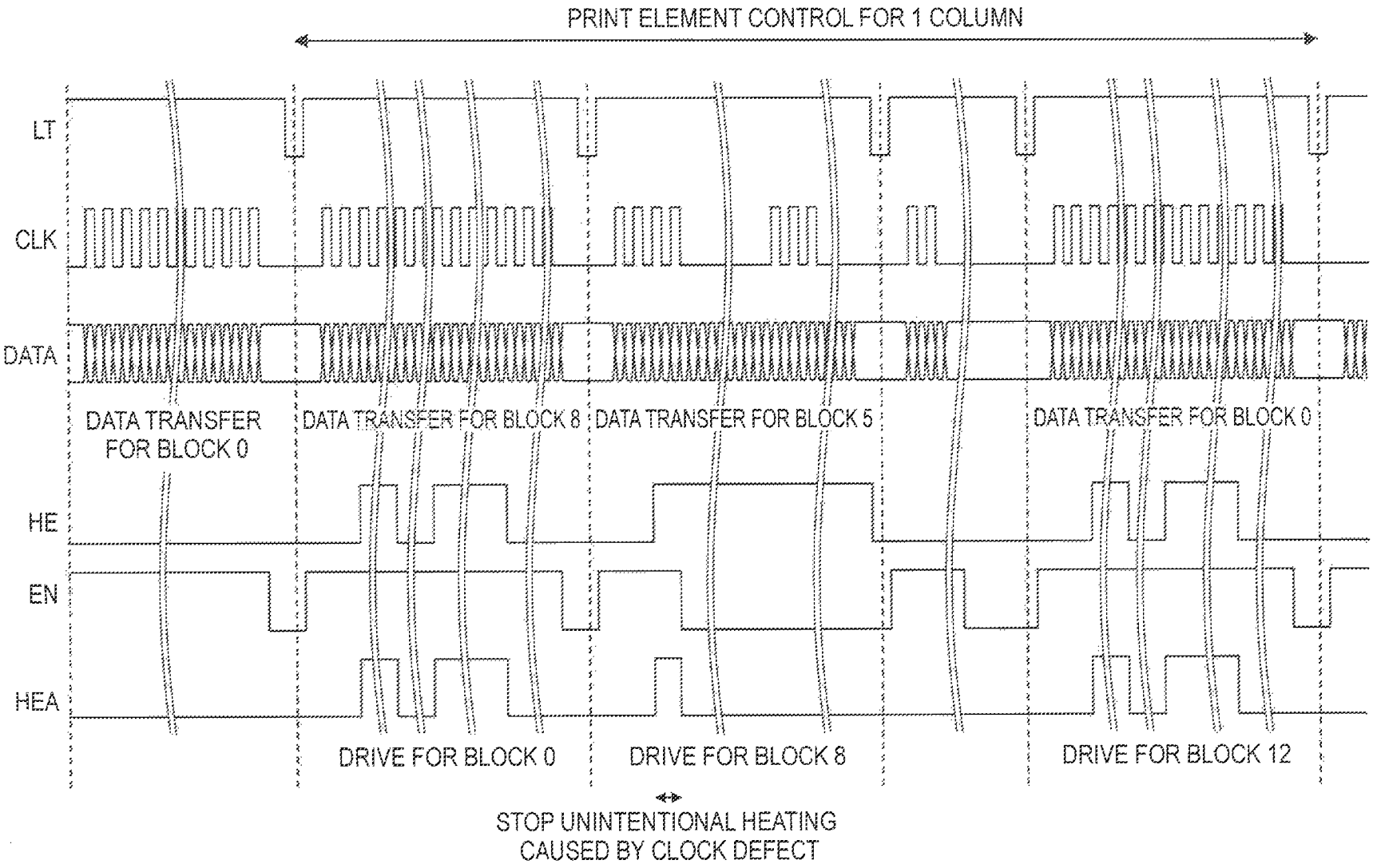
FIG. 11 is a timing chart for illustrating the control signal exhibited when loss of the clock is detected.

FIG. 11 is a timing chart for illustrating the generation of a drive signal exhibited when the detection circuit 300 illustrated in FIG. 9 is used. In the same manner as in FIG. 5 and FIG. 8, a relationship between a clock signal CLT, the latch signal LT, and the data signal DATA and the drive signals is indicated in FIG. 11. In this case, it is assumed that a defect has occurred in the clock signal CLK at the same timing as that illustrated in FIG. 8. In FIG. 11, two drive signals, namely, the drive signal HEA and a drive signal HEA are illustrated. Of those, the drive signal HE is a drive signal generated only based on the counting of the clock signal CLK based on the command in the same manner as that illustrated in FIG. 8, and continues the enable state when loss of a clock occurs. In contrast, the drive signal HEA represents a drive signal obtained by generating the enable signal EN based on the presence or absence of the clock signal CLK by the circuit illustrated in FIG. 9 and controlling the enable state by the enable signal EN. The drive signal I-EA can be easily generated by taking the logical product of the drive signal HE generated from the command and the enable signal EN. In this embodiment, the heater selection drive unit 312 actually uses the drive signal HEA to drive each of the recording elements 202. Through use of the drive signal HEA, assuming that the recording element 202 is a heater element, unintentional heating can be stopped when loss of a clock occurs.

The clock signal CLT may sometimes be input to the recording head 102 again after loss of a clock occurs and before the latch signal LT is subsequently asserted. It is conceivable that the drive signal HE generated within this period is not correctly set in terms of, for example, its pulse width. In this embodiment, the enable signal EN is disabled through use of the falling edge of the clock state signal COR, and still remains disabled even when the clock signal CLT is input again before the latch signal LT is subsequently asserted. As a result, in comparison with the drive signal HE assumed to have been incorrectly set, the drive signal HEA maintains the disable state, which inhibits the recording elements 202 from being driven.

According to this embodiment, in the recording apparatus in which the main body unit and the recording head 102 are connected to each other by the cable 111, when data transfer is performed while the recording head 102 is being moved in the main scan direction, loss of a clock that has occurred can be detected based on a position of the cable 111 and a state thereof. In addition, by disabling the drive signal when loss of a clock is detected, it is possible to prevent occurrences of a failure of the recording element 202 and breakage of the recording head 102.

In the above-mentioned recording apparatus, the recording head 102 disables the drive signal when loss of a clock is detected, but it is also possible to hold status information indicating that the drive signal has been disabled in the error memory unit 313 included in the recording head 102. For example, by taking the logical product (AND) of a signal obtained by inverting the enable signal EN (signal that becomes "1" when disabled) and the drive signal HE generated from the command, it is also possible to detect that the drive signal HE has been generated even under loss of a clock state. The error memory unit 313 enables and holds loss of a clock detection value being the status information, and outputs an error signal ERR to the main body unit (not shown) of the recording apparatus, to thereby be able to notify the main body unit that the drive signal has been disabled. At this time, it is possible to clear loss of the clock detection value held in the recording head 102 by the command data obtained from the main body unit of the recording apparatus. When the recording is normally performed by, for example, replacing the cable 111, the recording head 102 outputs loss of the clock detection value to the main body unit of the recording apparatus as a disable value.

When the main body unit of the recording apparatus receives the error signal ERR, the main body unit can notify a user that data cannot be correctly transferred to the recording head 102 through use of a display panel or a light emitting diode (LED) for displaying an error, which is provided to the recording apparatus. In the recording apparatus according to this embodiment, the enable period of the drive signal applied to the recording element 202 does not exceed the predetermined time period, and hence there is no fear that the recording head 102 may break due to loss of a clock. Therefore, the user who has received the notification is only required to replace the cable 111 without replacing the recording head 102.

In the recording apparatus according to this embodiment, the error memory unit 313 of the recording head 102 may also enable and hold loss of the clock detection value, and may return loss of the clock detection value to the main body unit only when there is a read command from the main body unit of the recording apparatus. When receiving loss of the clock detection value, the main body unit notifies the user that an error has occurred in the same manner as described above to prompt the user to replace the cable 111. Also in this case, it is possible to clear loss of the clock detection value held in the error memory unit 313 by the command data obtained from the main body unit. After the recording is normally performed by, for example, replacing the cable 111, the error memory unit 313 outputs loss of the clock detection value to the main body unit of the recording apparatus as a disable value when receiving the read command.

The embodiment in which the present invention is applied to the recording head configured to perform the recording by repeating the reciprocation in the main scan direction has been described above, but the present invention is not limited to this embodiment. This is because the defect in the clock signal can be caused by a factor other than the repetition of the reciprocation in the main scan direction. Therefore, for example, the present invention can also be applied to a full-line recording head or other such recording head configured to perform recording without repeating the reciprocation in the main scan direction.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-220951, filed Nov. 16, 2017, which is hereby incorporated by reference herein in its entirety.

What is claimed is:

1. A recording head, which includes a recording element, and is configured to perform recording on a recording medium by driving the recording element based on a first clock signal transmitted from a main body unit of a recording apparatus via a cable, the recording head comprising:

a first generation unit configured to generate a second clock signal by shifting a phase of the first clock signal by at least one-half phase;

a second generation unit configured to generate a logical sum signal based on a logical sum of a plurality of signals including the first clock signal and the second clock signal; and a detection unit configured to detect whether a wire break has occurred in the cable based on the logical sum signal.

2. A recording head according to claim 1, wherein the detection unit is configured to detect that a wire break has occurred in the cable when the logical sum signal transitions from a high state to a low state.

3. A recording head according to claim 1, wherein the recording element stops being heated when the detection unit detects that a wire break has occurred in the cable.

4. A recording head according to claim 1, wherein the plurality of signals include the first clock signal, the second clock signal, and a third clock signal, wherein the third clock signal is further generated by shifting the phase of the first clock signal so as to become different from the second clock signal in phase.

5. A recording head according to claim 1, further comprising an error memory unit configured to hold status information indicating whether a wire break has occurred in the cable.

6. A recording head according to claim 1, further comprising an output unit configured to output an error signal to the main body unit when the detection unit detects that a wire break has occurred in the cable.

7. A recording head according to claim 1, wherein the detection unit is configured to detect whether a wire break has occurred in the cable under a state in which the recording head is being moved in a main scan direction.

8. A recording head according to claim 1, wherein the detection unit is configured to detect whether a wire break has occurred in the cable under a state in which the recording head is performing the recording.

9. A recording head according to claim 1, wherein the second clock signal is generated by shifting the phase of the first clock signal by one-half phase.

10. A recording apparatus comprising the recording head of claim 1, the recording head being configured to form an image on a recording medium.

11. A recording head, which includes a recording element, and is configured to perform recording on a recording medium by driving the recording element based on a first clock signal transmitted from a main body unit of a recording apparatus via a cable, the recording head comprising:

a first generation unit configured to generate a second clock signal by shifting a phase of the first clock signal by at least one-half phase;

a second generation unit configured to generate a logical sum signal based on a logical sum of a plurality of signals including the first clock signal and the second clock signal; and a control unit configured to control heating of the recording element based on the logical sum signal.

12. A recording head according to claim 11, wherein the control unit is configured to control the heating of the recording element based on the logical sum signal that has transitioned from a high state to a low state.

13. A recording head according to claim 11, wherein the controlling of the heating of the recording element includes controlling of whether the heating of the recording element is to be stopped.

14. A recording head according to claim 11, wherein the plurality of signals include the first clock signal, the second clock signal, and a third clock signal, wherein the third clock signal is further generated by shifting the phase of the first clock signal so as to become different from the second clock signal in phase.

15. A recording head according to claim 11, wherein the control unit is configured to control the heating of the recording element based on the logical sum signal under a state in which the recording head is being moved in a main scan direction.

16. A recording head according to claim 11, wherein the control unit is configured to control the heating of the recording element based on the logical sum signal under a state in which the recording head is performing the recording.

17. A recording head according to claim 11, wherein the second clock signal is generated by shifting the phase of the first clock signal by one-half phase.

* * * * *